United States Patent [19]

O'Link

[11] 3,956,786

[45] May 18, 1976

[54] LIFE PRESERVER VEST

[75] Inventor: Maurice H. O'Link, St. Cloud, Minn.

[73] Assignee: Stearns Manufacturing Company, St. Cloud, Minn.

[22] Filed: Jan. 23, 1975

[21] Appl. No.: 543,407

[52] U.S. Cl. ..... 9/345; 9/342
[51] Int. Cl.[2] ..... B63C 9/10
[58] Field of Search ..... 9/329, 333, 336–340, 9/342, 345

[56] References Cited

UNITED STATES PATENTS

| | | | |
|---|---|---|---|
| 2,563,122 | 8/1951 | Levine | 9/342 |
| 3,181,183 | 5/1965 | Allen | 9/333 |
| 3,903,555 | 9/1975 | Busby | 9/342 |

FOREIGN PATENTS OR APPLICATIONS

| | | | |
|---|---|---|---|
| 1,007,069 | 10/1965 | United Kingdom | 9/345 |
| 1,123,941 | 2/1962 | Germany | 9/333 |

*Primary Examiner*—Trygve M. Blix
*Assistant Examiner*—Stuart M. Goldstein
*Attorney, Agent, or Firm*—Merchant, Gould, Smith, Edell, Welter & Schmidt

[57] ABSTRACT

A personal flotation device having a buoyant collar, a front bib section containing a flotation element and a back section, the bib and back sections having lower portions that may be overlapped so as to cooperate with the collar to define armholes, the collar having a central opening for the neck of the wearer. The collar comprises front and rear collar sections pivotally secured together on an axis extending diametrically of the neck receiving opening and transversely of the device.

7 Claims, 5 Drawing Figures

LIFE PRESERVER VEST

The flotation device of this invention is intended primarily for use with small infants weighing less than thirty pounds as well as children weighing from approximately thirty pounds to fifty pounds or more. In producing personal flotation devices for such persons, it is important that, not only the necessary buoyancy be achieved, but also that the device provide positive righting moment. In other words, the device should urge the wearer into a stable generally upright position, wherein the head is supported above the water in a position in which will not restrict breathing and prevented from moving into a face-down position in the water.

SUMMARY OF THE INVENTION

The personal flotation device of this invention includes a collar, a front bib section and a rear back section. The collar comprises a pair of front and rear collar sections each including a buoyant element, the sections cooperating to define a central opening for the neck of the wearer. The collar sections have means for pivotally securing the same together on an axis extending diametrically through the neck receiving opening and transversely of the device. The bib section is also provided with a buoyant element. The bib and back sections have lower portions that extend transversely of the device and which are wrapped into overlapping relationship at the sides of the wearer, cooperating with the collar to define armholes. The lower extended portions have fasteners for releasably securing the overlapping parts together. The buoyant elements of the bib and collar sections cooperate to provide proper positive righting moment to a wearer, to move the wearer toward a generally stable upright position in the water with the wearer's head being supported in a generally head-up attitude.

DETAILED DESCRIPTION OF THE PREFERRED EMBODIMENT

Figure 1:
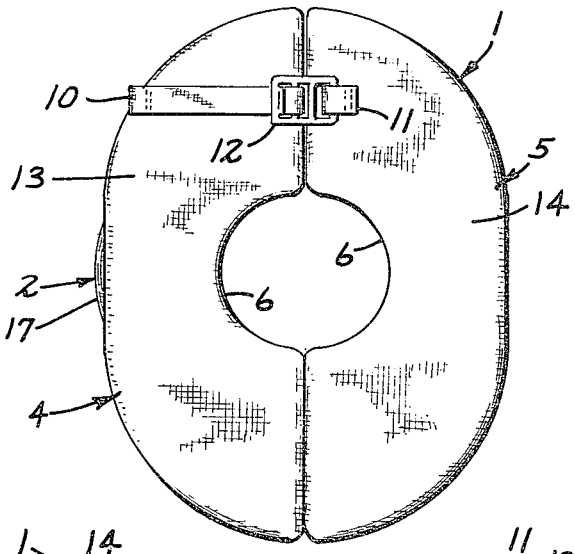
FIG. 1 is a view in plan of the personal flotation device of this invention.
Figure 2:
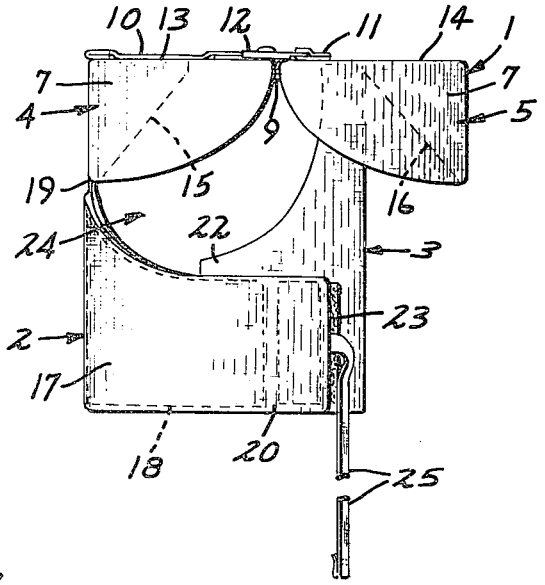
FIG. 2 is a view in side elevation.
Figure 2:
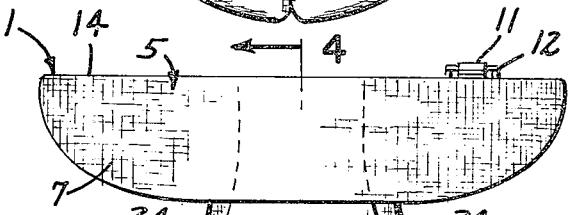
Figure 3:
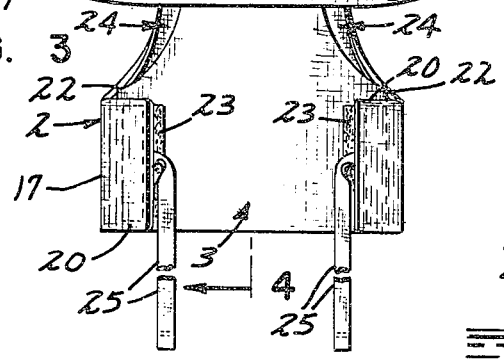
FIG. 3 is a view in rear elevation.

The personal flotation device of this invention involves a collar 1, generally in the shape of an elliptical or compressed annulus, a front bib section 2, and a rear back section 3, the collar 1 comprising front and rear collar sections 4 and 5 respectively. The collar sections 4 and 5 cooperate to define a central opening 6 for reception of the neck of a wearer. The collar sections 4 and 5 each comprise an outer shell 7 preferably made from textile fabric, such as nylon or other suitable material, and a buoyant or flotation element 8 which may be made from any suitable flotation material, such as closed-cell foam plastics, preferably polyvinyl choloride or polyethylene.

The collar sections 4 and 5 are pivotally secured together on a normally generally horizontal axis that extends diametrically through the neck receiving opening 6 and transversely of the device. At one side of the neck receiving opening 6, the shell portions 7 of the collar sections 4 and 5 are provided with flexible flanges 9 that are stitched or otherwise secured together. Diametrically opposite the stitched together portions of the collar sections 4 and 5, the collar sections are adapted to releasably secured in substantially abutting pivotal relation by a suitable releasable fastener means such as a pair of flexible straps 10 and 11 stitched or otherwise anchored to respective collar sections 4 and 5, and a cooperating buckle 12 permanently secured to the strap 11 and adapted to be engaged by the strap 10. The collar sections 4 and 5 have generally flat top surface portions 13 and 14, respectively, and respective angular surface portions 15 and 16. The top surface portions 13 and 14 are adapted to be disposed under the chin and back of the head respectively of the wearer, as shown in FIG. 5, the angular surface portions 15 and 16 being adapted to overlie the upper chest and back portions respectively of the wearer.

The bib section 2 comprises a shell 17 of textile fabric enclosing a buoyant or flotation element 18, the bib section 2 having an intermediate upper portion that is secured to the bottom edge of the front collar section 4 at the outer peripheral wall thereof, as indicated at 19. The bib 2 has a lower portion 20 that extends transversely in opposite directions so as to be partially wrapped around the chest of the wearer.

Figure 4:
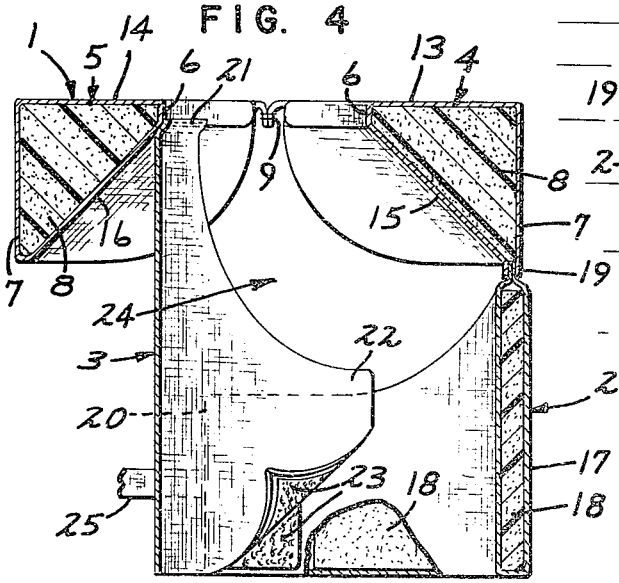
FIG. 4 is a transverse section taken on the line 4—4 of FIG. 3, some parts being broken away.

The back section 3 has an intermediate upper end portion that extends upwardly to the radially inner portion of the rear collar section 5 and is secured thereto adjacent that portion of the opening 6 defined by the rear collar section 5, as indicated at 21 in FIG. 4. Like the bib section 2, the back section 3 is formed to provide transversely extended lower portions 22 be partially wrapped around the wearer's chest and to be overlapped by the portions 20 of the bib 2. The portions 20 and 22 are provided with quickly attached and released fastener devices 23 on their extended ends for releasably holding the portions 20 and 22 in overlapped relationship. An example of such fastener devices is a multi-hook and loop arrangement produced by the Velcro Corporation of New York, N.Y., and marketed under the trademark "Velcro". It will be noted that, when the transversely extended portions 20 and 22 are disposed in their overlapping relationship, the bib and back sections 2 and 3 respectively cooperate with the the collar 1 to define armholes 24 through which the wearer's arms can comfortably extend. Preferably, and as shown, the side edges of both bib and back sections 2 and 3 respectively diverge in downwardly and laterally outwardly extending curves so as to become the upper edges of transversely extended portions 20 and 22. This arrangement enables the flotation device of one given size to fit wearers of different dimensions. When the device is worn by a person of larger chest dimensions, the overlap between the portions 20 and 22 is less than the device is worn by a person having smaller chest measurements. The curvature of the above mentioned edges causes the armholes 24 to vary in size in a generally vertical direction when worn by different persons. Thus, when the device is on a smaller person, the smaller dimension of the armholes 24 effectively prevents the device from riding up on the wearer, and keeps the collar in place on the wearer's shoulders, particularly the front collar section 4 substantially against upper portion of the wearer's chest. To further aid in holding the device on the wearer's person, a pair of flexible tie members 25 are each fastened to a different end of the extended portions 20 and are adapted to be tied together behind the lower portion of the back section 3, as shown in FIG. 5.

Figure 5:
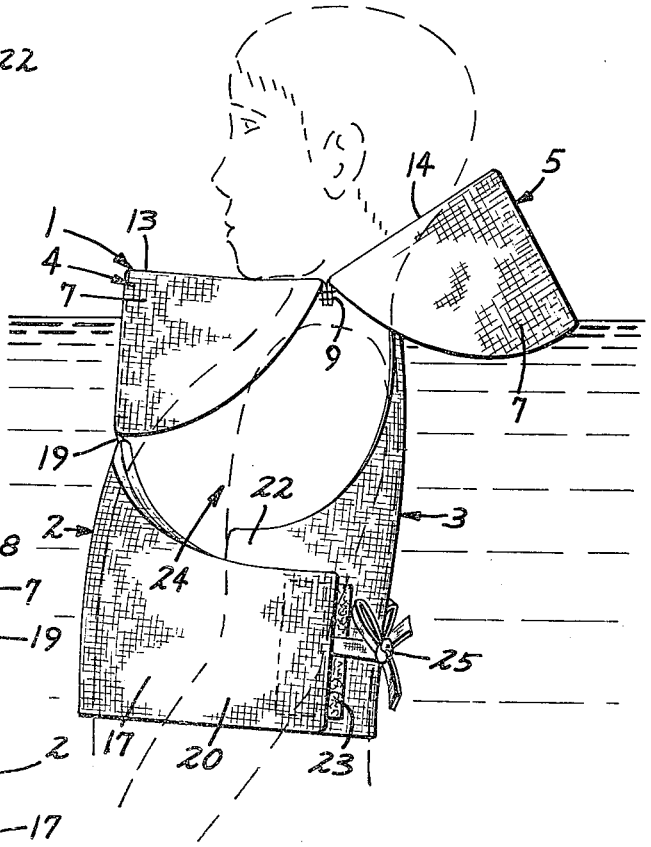
FIG. 5 is a view in side elevation, showing the flotation device in use.

When a child, wearing the above described flotation device, falls into or otherwise enters the water, the flotation elements 8 in the collar sections 4 and 5 cause the child's head to be carried above the water, as shown in FIG. 5. The buoyancy of the flotation element 18 in the bib section 2 provides turning force or positive righting moment to the wearer, to urge the wearer toward a generally upright position in the water whether the body of the wearer is generally straight or assumes a fetal position. The front collar section 4 urges the wearer's head generally upwardly to prevent the wearer's face from being immersed in the water. At the same time, the rear collar section engages the back of the wearer's head to support the head in a generally erect position above the water.

The connection of the bib section 2 to the peripheral portion of the front collar section 4 prevents the front collar section from being pivotally moved upwardly to cover the wearer's face and restrict breathing. The connection of the back section 3 to the rear collar section 5 adjacent the neck receiving opening 6 lends freedom to the rear collar section to swing generally upwardly to support the back of the wearer's head. The generally elliptical outline of the collar 1, wherein the axis thereof from side to side of the wearer is substantially longer than the axis from front to rear of the wearer, provides a buoyant or flotation arrangement that is highly effective in preventing the wearer's face from being immersed, in the event that the wearer tilts and then rolls to either side. Thus, the head of the wearer will be properly supported above the water. With the buoyancy afforded by the front and rear collar sections 4 and 5, a safety device is provided that not only provides effective personal flotation for the wearer, but also one which may be worn by a small child in comfort and without interfering with free movement of the child at play in or near the water.

While I have shown the back section 3 as being devoid of flotation elements, it will be appreciated that such may be provided if desired or necessary. Further, it will be noted that any one or all of the flotation elements 8 or 18 may be in the nature of hollow members inflated with a suitable gas, if desired. It will be understood that the device is capable of other modifications without departure from the spirit and scope of the invention as defined in the claims.

I claim:

1. A personal flotation device including:

a. a collar, a front bib member and a rear back member;

b. said collar comprising front and rear sections defining a neck receiving opening;

c. said collar sections including flotation elements of substantially equal buoyancy;

d. means including a releasable connector element pivotally securing said collar sections together on a normally substantially horizontal axis extending transversely of the garment at said opening;

e. said bib and back members having lower portions extending transversely thereof and upper ends, each lower portion having opposite end portions for overlapping face to face engagement with the end portions of the other thereof, the overlapping portions cooperating with said collar to define armholes, the upper end of said front member being secured to said front collar section at a peripheral portion of said front collar section in forwardly spaced relation to said neck receiving opening, the upper end of said rear member being secured to said rear collar section at said opening;

f. and a flotation element in said bib member imparting sufficiently greater buoyancy to the bib member than that of said back member, when worn in water, to provide positive righting moment to the wearer.

2. The personal flotation device defined in claim 1 in which said bib and back portions each have opposite side edges which curve downwardly and transversely outwardly to provide upper edges of their respective transversely extending lower portions, whereby to vary the size of said armholes according to the extent of overlap of said overlapping portions.

3. A personal flotation device including:

a. a collar comprising a pair of cooperating front and rear collar sections, each including a buoyant element, said sections cooperating to define a transversely generally central opening for reception of the neck of a wearer, said front section having an outer peripheral portion remote from said neck receiving opening;

b. means pivotally connecting said collar sections together on a normally generally horizontal axis extending transversely of the device at said central opening;

c. a front bib member having an upper end secured to the front collar section at said peripheral portion thereof;

d. a rear back member having an upper end secured to the rear collar section at said opening;

e. said bib and back members having transversely extending lower portions;

f. fasteners on said lower portions for releasably attaching the lower portions of one of said members in overlapping relationship to the lower portions of the other of said members to dispose said members in snugly encompassing relationship to the chest portion of the wearer and provide side portions that cooperate with said collar to define armholes;

g. and a buoyant element in said bib section.

4. The personal flotation device defined in claim 3 in which said collar sections have generally flat top surfaces and bottom surfaces diverging from said top surfaces in directions radially outwardly of said central opening and transversely outwardly of said means.

5. The personal flotation device defined in claim 3 in which said fasteners comprise hooks on one of said lower portions and hook receiving loops on the other of said lower portions, characterized by cooperating flexible tie elements on one of said lower portions and adapted to be tied together in overlying relationship to the other one of said lower portions.

6. The personal flotation device defined in claim 3 in which said lower portions of the bib and back members have opposite end portions defining fastener equipped overlapping surfaces for face to face locking engagement of said overlapping surfaces, characterized by flexible tie means for releasably locking said lower portions in said overlapping relationship of said surfaces thereof.

7. The personal flotation device defined in claim 3 in which said bib and back members each have opposite side edges which diverge downwardly toward the opposite ends of their respective transversely extending lower portions.

* * * * *